US008777697B2

(12) United States Patent
Deleris

(10) Patent No.: US 8,777,697 B2
(45) Date of Patent: Jul. 15, 2014

(54) VERY HIGH-PRESSURE LIQUID SPRAYING GUN FOR A VERY HIGH-PRESSURE LIQUID SPRAYING MACHINE, AND METHOD FOR MANUFACTURING SAME

(75) Inventor: Michel Deleris, Rebigue (FR)

(73) Assignee: Jedo Technologies, Labege (FR)

( * ) Notice: Subject to any disclaimer, the term of this patent is extended or adjusted under 35 U.S.C. 154(b) by 443 days.

(21) Appl. No.: 13/143,203

(22) PCT Filed: Feb. 17, 2010

(86) PCT No.: PCT/EP2010/000984

§ 371 (c)(1),
(2), (4) Date: Jul. 5, 2011

(87) PCT Pub. No.: WO2010/094462

PCT Pub. Date: Aug. 26, 2010

(65) Prior Publication Data

US 2011/0269382 A1 Nov. 3, 2011

(30) Foreign Application Priority Data

Feb. 17, 2009 (FR) ..... 09 00720

(51) Int. Cl.
*B24B 1/00* (2006.01)
*B24C 5/04* (2006.01)

(52) U.S. Cl.
USPC ..... 451/102; 29/463; 29/890.142; 451/90

(58) Field of Classification Search
USPC ..... 29/890.142, 890.143, 463; 156/296, 156/281; 239/336, 428, 429, 430; 417/151; 451/90, 91, 102
See application file for complete search history.

(56) References Cited

U.S. PATENT DOCUMENTS

| | | | | |
|---|---|---|---|---|
| 2,332,407 | A | 10/1943 | Davies | |
| 5,144,766 | A * | 9/1992 | Hashish et al. | 451/102 |
| 5,265,383 | A * | 11/1993 | Shank, Jr. | 451/102 |
| 5,283,990 | A * | 2/1994 | Shank, Jr. | 451/90 |
| 5,785,582 | A | 7/1998 | Stefanik et al. | |
| 6,293,857 | B1 * | 9/2001 | Allard | 451/102 |
| 6,425,805 | B1 * | 7/2002 | Massa et al. | 451/40 |
| 2003/0045217 | A1 * | 3/2003 | Massa et al. | 451/102 |

FOREIGN PATENT DOCUMENTS

| | | |
|---|---|---|
| DE | 297 02 397 U1 | 6/1997 |
| DE | 29702397 U1 | 6/1997 |
| DE | 196 40 920 C1 | 1/1998 |
| DE | 19640920 C1 | 1/1998 |

* cited by examiner

*Primary Examiner* — Timothy V Eley
(74) *Attorney, Agent, or Firm* — Defillo & Associates, Inc.; Evelyn A Defillo

(57) ABSTRACT

The invention relates to a gun for spraying liquid at a very high pressure, referred to as a focusing gun, and to a method for manufacturing same, according to which two elongate parts (2) are manufactured to be assembled so as to form the focusing gun. Each of said parts includes an assembly surface (J) comprising a central groove (3) for forming the duct of the focusing gun once the parts have been assembled, and a gluing tank (9) for being filled with an adhesive substance. Further, at least one of said parts (2) has a centering rib (6), projecting relative to the assembly surface thereof, while the other part has, for each centering rib (6), a centering cavity (7), the size of which is suitable for tightly housing said centering rib.

17 Claims, 2 Drawing Sheets

VERY HIGH-PRESSURE LIQUID SPRAYING GUN FOR A VERY HIGH-PRESSURE LIQUID SPRAYING MACHINE, AND METHOD FOR MANUFACTURING SAME

CROSS REFERENCE TO RELATED APPLICATION

This application is a national stage entry of PCT/EP2010/000984 filed Feb. 17, 2010, under the International Convention claiming priority over French Patent Application No. 0900720 filed Feb. 17, 2009.

FIELD OF THE INVENTION

The present invention relates to a method for manufacturing guns for spraying liquid at a very high pressure, and in particular guns for machines for working pieces using a jet of liquid at a very high pressure, in particular cutting and/or machining machines. It extends to the spraying guns produced according to this manufacturing method.

BACKGROUND OF THE INVENTION

The technique of cutting and/or machining using a jet of liquid at a very high pressure consists in spraying liquid at a pressure of from 1000 to 8000 bar. The liquid, generally pure water or water with additives is then ejected at a very high speed, from 600 to more than 1000 m/s, and directed onto the piece to be worked. Thus, the technique of machining using a jet of liquid at a very high pressure makes it possible to work numerous materials such as plastics, paper or metal alloys, and to do so without emitting dust or generating heat. In order to make it easier to cut the materials, abrasive particles may be added to the sprayed water.

The cutting heads used according to this cutting method conventionally comprise a collimation tube, a nozzle with a small internal diameter, a mixing chamber and a gun for spraying liquid at a very high pressure.

The liquid at a very high pressure enters through the collimation tube. The liquid is then sprayed through the nozzle and enters at a high speed into the mixing chamber provided with an abrasive particle inlet. The mixture of liquid and the abrasive particles is concentrated and the jet at a very high pressure is directed onto the piece to be worked by a gun with a small internal diameter. This gun is generally known by the term focusing gun.

Conventionally, such focusing guns are manufactured by machining from a solid piece.

These focusing guns, however, are pieces which have a large ratio of length to diameter, which makes it difficult to machine a duct from a solid piece. In particular, the machining does not make it possible to go below a certain internal diameter threshold for a given length. Yet the internal diameter of the focusing gun determines the precision of the liquid jet.

Furthermore, according to this manufacturing technique, the focusing guns are normally made of tungsten carbide. This is because this ceramic is easy to use and has a reasonable cost for such an application. However, such guns made of tungsten carbide can be used only with abrasives of the oxide type, such as garnet or aluminum oxide with a low relative hardness. This is because the use of abrasives with a hardness greater than that of tungsten carbide, from 8 to 9 on the Mohs scale, would rapidly wear the interior of the gun, leading to a premature loss of precision and a lifetime incompatible with the usual applications of machines for machining using a jet of liquid at a very high pressure.

Another method for manufacturing focusing guns consists in vapor depositing a ceramic on a cylindrical graphite support, then removing the cylindrical support by heating once the ceramic has formed a tubular structure around the graphite.

This method makes it possible in particular to manufacture guns made of silicon carbide, a ceramic which has a high hardness of the order of 9.5 on the Mohs scale, making it possible to work with a wide range of abrasives which are no longer limited to oxides.

This manufacturing method, however, turns out to be complex to implement and the production cost of the guns thus produced is high.

In order to overcome the problems associated with the length to internal diameter ratio of the gun, it has been envisaged to manufacture a focusing gun by assembling a plurality of elements. These elements may be cylindrical pieces of small height, and therefore with a low length to internal diameter ratio, which are aligned along the axis of the duct of the gun and kept assembled by clamping with an external piece of the sleeve type. This technique, however, is virtually unused. This is because it does not allow the various elements of the gun to be aligned correctly, and the alignment differences lead to perturbations of the flow of liquid at a very high pressure. Furthermore, the junction regions prove particularly sensitive to wear.

With a view to overcoming the drawbacks of the techniques above, another manufacturing method has consisted, as described particularly in U.S. Pat. No. 5,785,582 or DE 196 40 920, in producing focusing guns from two pieces provided with assembly faces by which they are intended to be joined in order, in the assembled state, to form a focusing gun. According to this method, a central groove is formed in the assembly face of each of the two pieces, this being formed in a planar median region of said assembly face and adapted to extend between the two ends thereof, said central grooves being adapted to form the duct of the focusing gun in the assembled position of the two pieces.

The problem which such a technique needs to resolve resides in obtaining precise positioning of the two pieces, making it possible to obtain a duct having perfectly controlled internal dimensions. At present, however, no solution makes it possible to resolve this problem satisfactorily.

Specifically, the current methods either require an expensive external mechanism (techniques described in DE 297 02 397 or U.S. Pat. No. 2,332,407), or do not guarantee perfect relative positioning and perfect holding of the two pieces during the phase of assembling them:

technique using a film enclosing the two pieces described in U.S. Pat. No. 5,785,582 technique of bonding the assembly faces of the two pieces, described in DE 196 40 920, according to which:

in the assembly face of at least one of the two pieces, laterally with respect to the planar median region thereof, at least one bonding reservoir is formed, which is intended to be filled with a quantity of adhesive substance adapted to adhere to the portion of the assembly face of the other piece lying opposite said reservoir, in the assembled position of the two pieces, each bonding reservoir is filled with adhesive substance, and the two pieces are placed in contact so that they are joined by their assembly face and connected by means of the adhesive substance.

SUMMARY OF THE INVENTION

The present invention aims to overcome the various drawbacks of the current techniques for manufacturing focusing guns, and its main object is to provide a method which is simple to carry out and has a low cost price, making it possible to control very precisely the shape and the dimensions of the spraying duct of the focusing gun.

It is another object of the invention to provide a method making it possible to manufacture focusing guns by using any type of materials, and in particular materials with a very high hardness such as ceramics of the silicon carbide type.

It is another object of the invention to provide a method making it possible to manufacture focusing guns which are compatible with a wide range of abrasives and have an increased lifetime regardless of the type of abrasive used.

To this end, the invention relates to a method for manufacturing focusing guns using the bonding technique described above, according to which, furthermore:

on the assembly face of at least one piece, at least one rib referred to as a centering rib is formed, which projects from said assembly face, and, for each centering rib formed on the assembly face of one piece, a cavity referred to as a centering cavity is formed in the assembly face of the other piece, this cavity having dimensions adapted to tightly receive said centering rib in the assembled position of the two pieces, in which the central grooves form the duct of the focusing gun.

Thus, according to the invention, the focusing gun consists of two pieces connected to one another by bonding, in which the prior relative positioning of the pieces is ensured by means of at least a centering rib and a centering cavity which are designed so as to cooperate in order to guarantee precision of the relative positioning, before the surfaces intended to be connected by bonding come in contact with one another. Thus, during the actual bonding, the two pieces are perfectly guided and can in no way experience any transverse relative displacement liable to affect their centering.

Furthermore, once assembled, the two pieces are directly in contact with one another in the planar median regions which make it possible to separate the bonding region and the duct of the focusing gun, and therefore lead to a safeguard against transfer of adhesive substance to said duct.

However, in order to reliably ensure against any transfer of adhesive substance to the duct of the focusing gun, according to the invention a centering rib is advantageously associated with each reservoir formed in the assembly face of a piece, this rib having a length at least equal to that of said bonding reservoir and being interposed between the latter and the central groove formed in said assembly face, so that each rib thus has the twofold function of a centering element and a barrier protecting the duct of the focusing gun.

It should also be noted that, owing to its position, this protective barrier not only preserves the integrity of the duct of the focusing gun but also leads to prevention of any migration of the adhesive substance to the planar median region, so that the two pieces come in contact with one another via "unpolluted" faces.

The contact between the two pieces thus consists in direct contact without significant play. Specifically, this play turns out to be greatly less than the diameter of the abrasive particles, so that the latter cannot become fixed in the gap between the pieces and prematurely wear the focusing gun.

According to an advantageous embodiment of the invention, a space referred to as an overflow space is associated with each reservoir formed in the assembly face of a piece, such that it communicates with said reservoir with a view to receiving the possible excess of adhesive substance during assembly of the two pieces, each of said overflow spaces being formed laterally on the other side of the associated reservoir from the planar median region.

Furthermore, the assembly faces of the two pieces are advantageously formed so that each overflow space consists of a slot extending from the periphery of the focusing gun, in the assembled position of the two pieces, and formed between said assembly faces opposite each bonding reservoir. Besides the absorption of an excess of adhesive substance, such an overflow space makes it possible to distribute this excess between the assembly faces of the two joined pieces and thus to increase the bonded surface of these assembly faces.

Furthermore, in order to enhance the bonding and advantageously according to the invention, for each bonding reservoir formed in one piece, the other piece has an assembly face comprising a planar region referred to as a bonding region, coplanar with the planar median region and adapted to extend in front of the associated bonding reservoir and to close the latter.

According to another advantageous embodiment of the invention, a focusing gun is produced from two identical pieces, each comprising at least one centering assembly consisting of a centering rib and a centering cavity which are arranged symmetrically on either side of the central groove.

Moreover, advantageously according to the invention, centering ribs are formed and centering cavities are formed, which extend over the majority of the pieces.

Thus, the positioning of the two pieces is perfectly secured over the entire length of these pieces and their manufacture is simplified.

Bonding reservoirs are likewise advantageously formed, consisting of grooves extending over the majority of the pieces.

With the bonding regions extending over the entire length of the focusing gun, the contact surface of the adhesive substance is maximized and the quality of the adhesion is therefore increased.

Furthermore, a bonding reservoir is advantageously formed in each piece.

Moreover, advantageously and according to the invention, the assembly faces of the pieces are cleaned before an adhesive substance is deposited.

Furthermore, the step of depositing an adhesive substance is advantageously preceded by a step of improving the adhesion of each reservoir and each bonding region, such as a step of erosion by attack by a laser, an acid or plasma, or a step of depositing a preparation layer, in particular based on silane.

During assembly, moreover, a pressure is advantageously exerted on the pieces after they have been brought in contact.

Furthermore, after assembly, the step of bonding the pieces by an adhesive substance is advantageously followed by a step of machining the focusing gun.

Moreover, an adhesive substance selected from epoxies, methacrylates, polyimides or a mixture thereof is advantageously used.

As regards the materials used, pieces made of a material with a hardness of more than 8 on the Mohs scale are advantageously used, for example and advantageously silicon carbide.

The manufacture of focusing guns from materials having a hardness greater than that of tungsten carbide, which is conventionally used, makes it possible to widen the range of products worked with the machines for cutting and/or machining using a jet of liquid at a very high pressure. This is because materials having a hardness of more than 8 on the Mohs scale can then be cut, and abrasive particles likewise having a high hardness can be used in order to facilitate this work without the risk of prematurely wearing the focusing gun.

The invention also extends to a gun for spraying liquid at a very high pressure, for a machine for spraying liquid at a very high pressure, referred to as a focusing gun, consisting of two pieces comprising assembly faces by which they are joined and in which the following are formed:

for each of the two pieces, a central groove formed in a planar median region of said assembly face and adapted to extend between the two ends thereof, so as to form the duct of the focusing gun, for at least one of the two pieces and laterally with respect to the planar median region thereof, at least one bonding reservoir intended to be filled with a quantity of adhesive substance adapted to adhere to the portion of the assembly face of the other piece lying opposite said reservoir.

According to the invention, this focusing gun furthermore comprises:

formed on the assembly face of at least one piece, at least one rib, referred to as a centering rib, which projects from said assembly face, and, for each centering rib formed on the assembly face of one piece and arranged in the assembly face of the other piece, a cavity, referred to as a centering cavity, tightly receiving said centering rib.

The invention also extends to a focusing gun comprising any of the characteristics mentioned in the claims or the description of the present application, taken individually or in combination.

BRIEF DESCRIPTION OF THE DRAWINGS

Other objects, characteristics and advantages of the invention will become apparent from the following detailed description referring to the appended drawings, which represent two preferred embodiments thereof by way of nonlimiting examples. In these drawings.

Figure 1:
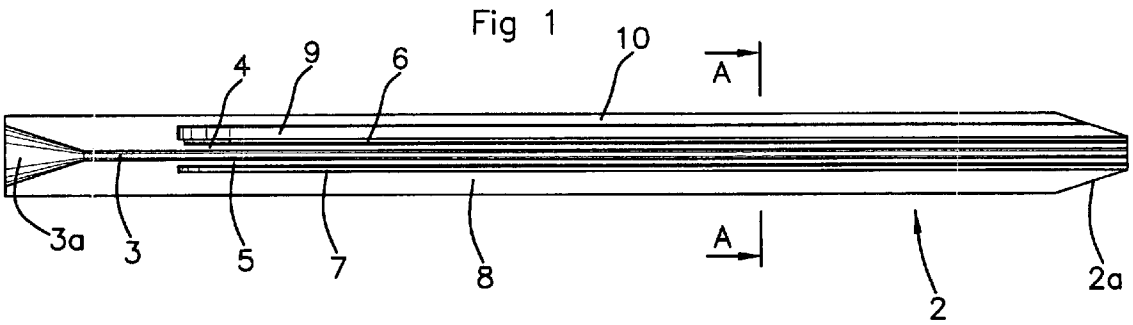
FIG. 1 is a view from above of a piece according to the invention, used for the manufacture of a focusing gun according to the invention.

The focusing gun represented in the figures is intended in the usual way to be mounted on a cutting head of a machine for spraying liquid at a very high pressure.

DETAILED DESCRIPTION OF A PREFERRED EMBODIMENT OF THE INVENTION

According to the invention, this focusing gun 1 consists of two elongate pieces 2, 2' comprising assembly faces J by which they are intended to be joined in order, in the assembled state, to form said focusing gun 1.

According to the example represented, these two pieces 2, 2' are identical. Over the majority of their length, they have a semicylindrical shape delimited by an assembly face J extending in a diametral plane (P), and they end in a distal end segment 2*a* of semi-frustoconical shape.

The dimensions of this piece 2 are determined as a function of the dimensions of the focusing gun 1 to be produced. Thus, in order to produce a focusing gun 1 having a length of from 20 mm to 150 mm with an external diameter of from 5 to 20 mm, pieces 2 having a length of from 20 to 150 mm with a width of from 5 mm to 20 mm, i.e. a radius of from 2.5 mm to 10 mm, for a piece 2 of semicylindrical shape will be used.

These pieces 2 furthermore consist of a material having a high hardness, preferably a hardness of more than 8 on the Mohs scale, with a view to making it possible to work materials having a hardness greater than the materials conventionally worked with tungsten carbide guns. Thus, these pieces 2 may in particular be made of tungsten carbide.

Firstly, each piece 2 comprises, formed in the junction face J and centered on the longitudinal symmetry plane (S) of said piece, a central groove 3 of semi cylindrical cross section adapted to form a cylindrical duct 12 in the assembled state of two pieces 2.

This central groove 3 extends over all of the piece 2 and, at the proximal end of this piece, comprises a semi-frustoconical widened segment 3*a* for introducing the pressurized liquid into the duct 12.

It should be noted that the central grooves 3 may have shapes other than semicylindrical, and may form ducts 12 having any cross sections, e.g. parallelepipedal etc. For example, a duct 12 of parallelepipedal shape may be selected for applications consisting in imparting a sweeping movement to the liquid jet.

It should also be noted that a coating made of a material different to the material constituting the pieces 2 may be deposited inside the central groove 3. This additional material preferably has a hardness greater than that of the pieces 2, and may for example consist of diamond. This material may, in particular, be applied by vapor deposition.

Figure 2:
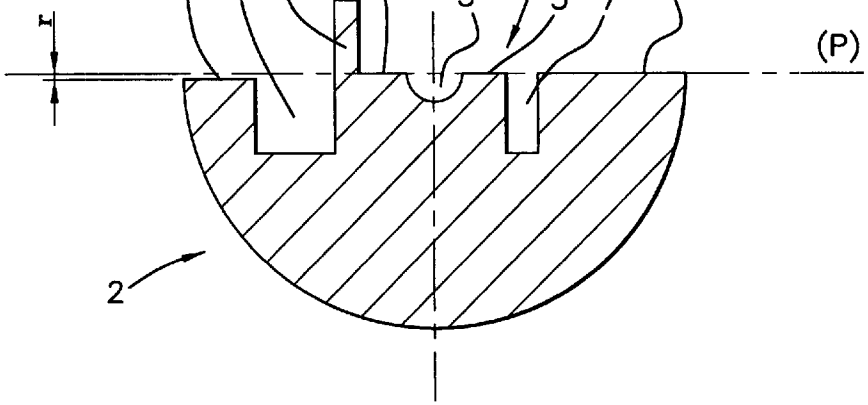
FIG. 2 is a section on an enlarged scale of this piece through a transverse plane A.

As represented particularly in FIG. 2, the assembly face J of each piece 2 has a planar median region 4, 5 divided into two half-regions 4, 5 extending respectively on either side of the central groove 3. This median region 4, 5 is furthermore coplanar with the diametral plane (P), so that the median regions of two assembled pieces 2 are in contact with one another.

Furthermore, along one of its longitudinal edges, this median region 4, 5 is bordered by a central rib 6 of rectangular parallelepipedal cross section projecting from the assembly face J.

Figure 4:
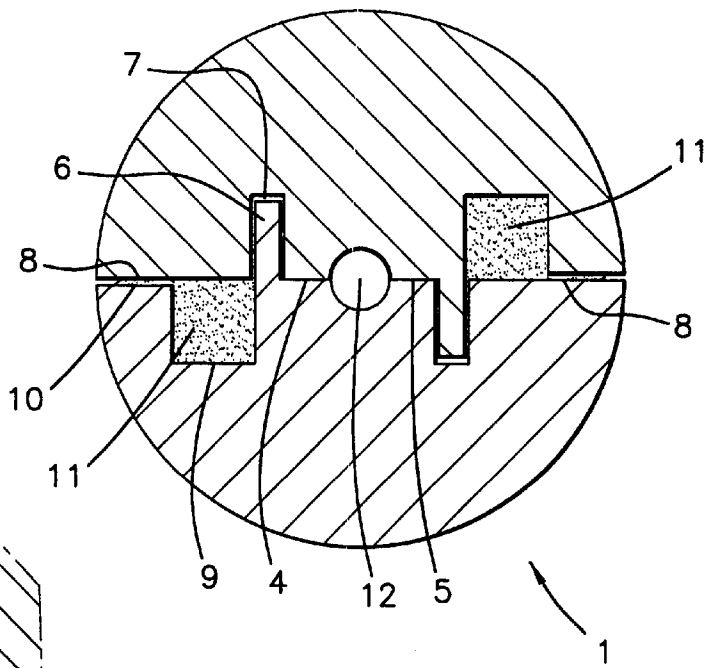
FIGS. 3 and 4 are cross sections through the transverse plane A representing two phases in the manufacture of the focusing gun according to the invention.
Figure 3:
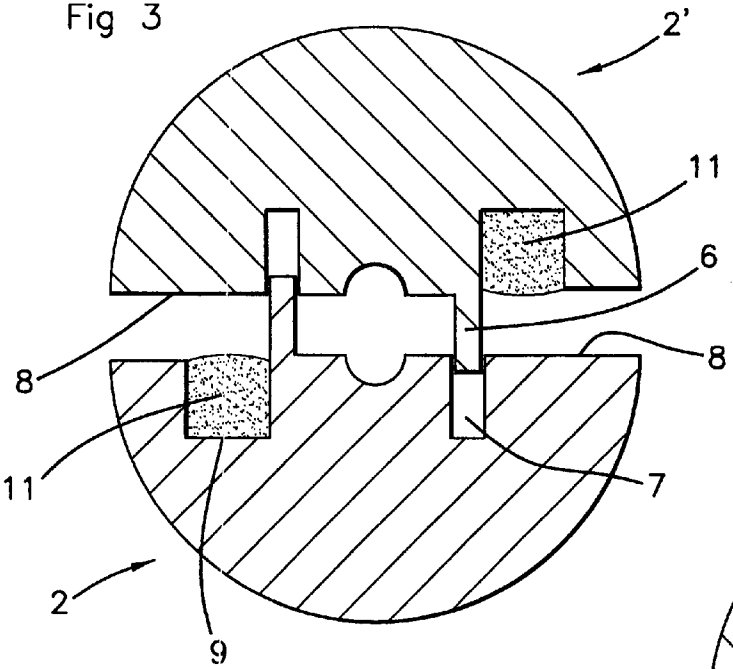

The other longitudinal edge of this median region 4, 5 is in turn bordered by a centering groove 7 having a cross section complementary to that of the centering rib 6, said centering rib and said centering groove being arranged symmetrically on either side of the symmetry plane (S) so that, as represented in FIGS. 3 and 4, the centering rib 6 of each piece 2, 2' is received in the centering groove 7 of the other piece 2, 2' when said pieces are being assembled.

Furthermore, the assembly face J of each piece 2 forms, between the centering groove 7 and the corresponding longitudinal edge of said piece, a planar lateral region 8 extending in the diametral plane (P) and therefore coplanar with the planar median region 4, 5.

This assembly face J furthermore comprises, laterally joined to the centering rib 6 and separated from the median region 4, 5 by said centering rib, a longitudinal groove 9 intended to form a reservoir for an adhesive substance 11 and to be closed, in the assembled position of two pieces 2, 2' and as represented in FIG. 4, by the lateral region 8 of the opposing piece 2.

As represented in FIG. 1, each of the grooves 7, 9 and ribs 6 extends longitudinally from the distal end of each piece 2, substantially over three fourths of the length of said piece.

Lastly, the assembly face J of each piece 2 forms, between the reservoir 9 and the corresponding longitudinal edge of said piece, a planar lateral region 10 extending substantially set back from the diametral plane (P) so that the lateral region 10 of one piece 2 delimits a slot, opening laterally at one of the generatrices of the focusing gun 1, with the opposing lateral face 8 of the second piece 2' forming said focusing gun.

This slot 8-10 thus forms a duct for discharge of the possible excess of adhesive substance and for distributing this excess between the assembly faces J of two assembled pieces 2, 2', thus making it possible to increase the bonded surface of these assembly faces.

Figure 5:
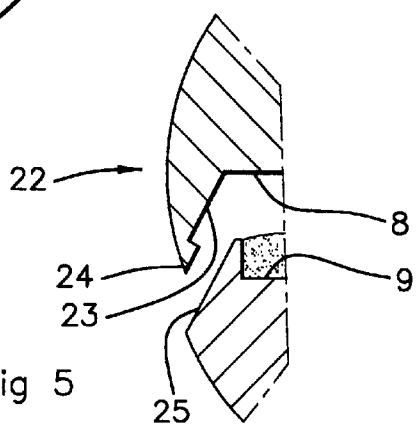
FIG. 5 is a partial section through the transverse plane A of a variant of a focusing gun according to the invention during assembly.

FIG. 5 represents an alternative embodiment according to which the planar lateral region bordering the reservoir 9 consists of a planar face 25 making an obtuse angle of the order of 120 degrees with the diametral plane (P).

Identically, the lateral region 8 bordering the centering groove 7 forms a dihedron having an apex angle of the order of 120 degrees, one of the two half-planes 23 of which is adapted to extend parallel to the plane face 25 and to delimit therewith a volume for retaining the excess of adhesive substance, which is closed at the periphery of the focusing gun 1 by a longitudinal border 24 projecting from said half-plane 23.

According to this alternative embodiment, the amount of adhesive substance filling the retention volume is made to work in shear and not in tension, so that it increases the adhesion power of said adhesive substance.

The steps in the manufacture of a focusing gun 1 by means of two identical pieces 2, which are represented in FIGS. 1 and 2, will be described below particularly with reference to FIGS. 3 and 4.

First, after having produced the pieces 2, 2' and before filling the reservoirs 9 with adhesive substance 11, a preliminary step consists in carrying out cleaning of the assembly faces J of the two pieces. Residues which may have been generated by the manufacture of the latter are thus eliminated.

It should furthermore be noted that this cleaning is essential at the reservoirs 9 and the planar lateral regions 8 for closing said reservoirs. Specifically, this cleaning prevents residues present on these surfaces from reducing the adhesion of the adhesive substance 11.

The cleaning may, for example, comprise a first step of degreasing the pieces 2 followed by pickling with an acid, and final cleaning with a solvent in order to remove the residues generated by the acid attack.

Furthermore, before the reservoirs 9 are filled with the adhesive substance 11, a second operation consists in improving the adhesion of the bonding surfaces, namely walls of the reservoirs 9, lateral regions 8 and lateral regions 10.

This improvement of the adhesion may be carried out by erosion of said bonding surfaces, for example by attack using a laser, an acid or plasma. The improvement of the adhesion may also be carried out by depositing a preparation layer, for example based on silane.

The next operation consists in filling each reservoir with an adhesive substance 11. This deposition may in particular be carried out by screenprinting, by depositing an adhesive film, by depositing a bead or by any other known way of depositing an adhesive substance 11.

Furthermore, the adhesive substance 11 may be an epoxy, methacrylates, polyamides or a mixture of these components. Preferably, the substance used thus consists of a film of epoxy or bismaleide.

As represented in FIGS. 3 and 4, the junction faces J of the two pieces 2 and 2' are then positioned opposite one another, and the two pieces 2, 2' are brought together until the centering ribs 6 penetrate into the centering grooves 7, a position from which the two pieces 2, 2' are then perfectly guided and can in no way experience any transverse relative displacement liable to affect their centering.

They then continue to be brought together until the regions of the assembly faces J lying in the diametral plane (P) are respectively either in contact with one another or in their position closing the reservoirs 9.

Furthermore, during contact of the adhesive substance with the planar faces 8 opposite the reservoirs 9, the possible flow of this substance necessarily takes place in the direction of the slot 8-10 owing to the presence of the protective barrier which, in the opposite direction, is constituted by the centering rib 6. Thus, not only does this flow not affect the cleanness of the median regions 4, 5, but furthermore it leads to an increase of the bonding surfaces.

At the end of assembly, the contact obtained between the two pieces 2, 2', particularly in the median regions 4, 5, thus consists in direct contact without significant play, so that the dimensions of the duct 12 of the focusing gun 1 depend only on the dimensions of the central grooves 3.

The next operation consists in exerting a pressure on the pieces 2, 2' brought in contact in this way, and in maintaining this pressure for the time necessary for satisfactory fixing of the pieces by the adhesive substance 11.

This time depends in particular on the nature of the adhesive substance, the temperature and the humidity. It will be determined according to the instructions provided by the manufacturer of the adhesive substance 11.

Once connected by means of the adhesive substance 11, the pieces 2, 2' form a focusing gun 1 ready for use.

Nevertheless, the bonding step may be followed by a step of machining or finishing the exterior of the focusing gun 1 in order to modify its shape, modify its external diameter or remove the residues generated by the bonding.

The invention claimed is:

1. A method for manufacturing a focusing gun (1) for spraying a liquid at a very high pressure, for a machine for spraying liquid at a very high pressure, comprising:

two pieces (2, 2), each piece comprising an assembly face (J), wherein the two pieces (2, 2') are joined to form the focusing gun (1):

wherein each assembly face (J) includes a central groove (3) formed in a planar median region (4, 5) of each said assembly face and adapted to extend between two ends thereof, said central grooves being adapted to form a duct (12) of the focusing gun (1) in the assembled position of the two pieces (2, 2'), wherein in the assembly face (J) of at least one of the two pieces (2, 2'), laterally with respect to the planar median region (4, 5) thereof, at least one bonding reservoir (9) intended to be filled with a quantity of adhesive substance (11) adapted to adhere to a portion of the assembly face (J) of the other piece (2', 2) lying opposite said reservoir, in the assembled position of the two pieces, wherein each bonding reservoir (9) is filled with adhesive substance (11), and the two pieces (2, 2') are placed in contact so that they are joined by their assembly faces (J) and connected by means of the adhesive substance (11), said method being characterized in that:

wherein on the assembly face (J) of at least one piece (2, 2'), at least one centering rib (6) is formed, which projects from said assembly face, and, wherein for each centering rib (6) formed on the assembly face (J) of one piece (2, 2'), a central cavity (7) is formed in the assembly face (J) of the other piece (2', 2), the central cavity having dimensions adapted to tightly receive each said respective centering rib in the assembled position of the two pieces, in which the central grooves (3) form the duct (12) of the focusing gun (1).

2. The method as claimed in claim 1, wherein each centering rib (6) is associated with each bonding reservoir (9) each centering rib having a length at least equal to that of said bonding reservoir and being interposed between the latter and the central groove (3) formed in said assembly face.

3. The method as claimed in claim 2, wherein the centering ribs (6) are formed and the centering cavities (7) are formed, which extend over the majority of each respective piece (2, 2').

4. The method as claimed in claim 1, wherein an overflow space (10) is associated with each bonding reservoir (9), such that the overflow space communicates with said reservoir with a view to receiving the possible excess of adhesive substance (11) during assembly of the two pieces, each of said overflow spaces being formed laterally on the other side of an associated bonding reservoir (9) from the planar median region (4, 5).

5. The method as claimed in claim 4, wherein the assembly faces (J) of the two pieces (2, 2') are formed so that each overflow space consists of a slot (10) extending from the periphery of the focusing gun (1), in the assembled position of the two pieces, and formed between said assembly faces opposite each bonding reservoir (9).

6. The method as claimed in claim 5, wherein for each bonding reservoir (9) formed in one piece (2, 2'), the other piece has an assembly face (J) comprising a planar region (8) referred to as a bonding region, coplanar with the planar median region (4, 5) and adapted to extend in front of the associated bonding reservoir (9) and to close the latter.

7. The method as claimed in claim 6, wherein each bonding reservoir (9) includes grooves extending over the majority of the pieces (2, 2').

8. The method as claimed in claim 1, wherein the two pieces are identical, each comprising at least one centering assembly consisting of a centering rib (6) and a centering cavity (7) which are arranged symmetrically on opposite sides of a respective central groove (3).

9. The method as claimed in claim 1, wherein a bonding reservoir (9) is formed in each piece (2, 2').

10. The method as claimed in claim 1, wherein the assembly faces (J) of the pieces (2, 2') are cleaned before an adhesive substance (11) is deposited.

11. The method as claimed in claim 1, wherein the step of depositing an adhesive substance (11) is preceded by a step of improving the adhesion of each bonding reservoir (9) and each bonding region (8), wherein the step of improving the adhesion is selected from erosion by attack by a laser, an acid, or plasma, depositing a preparation layer, based on silane.

12. The method as claimed in claim 1, wherein a pressure is exerted on the pieces (2, 2') after they have been brought into contact.

13. The method as claimed in claim 1, wherein the step of bonding the pieces (2, 2') by an adhesive substance is followed by a step of machining the focusing gun (1).

14. The method as claimed in claim 1, wherein an adhesive substance selected from epoxies, methacrylates, polyimides or a mixture thereof is used.

15. The method as claimed in claim 1, wherein the pieces (2, 2') are made of a material with a hardness of more than 8 Mohs.

16. The method as claimed in claim 1, wherein the pieces (2, 2') made of silicon carbide are used.

17. A focusing gun for spraying liquid at a very high pressure, for a machine for spraying liquid at a very high pressure, comprising:

two pieces (2, 2') comprising assembly faces (J) joined to form the focusing gun for each of the two pieces (2, 2'), a central groove (3) formed in a planar median region (4, 5) each of said assembly face and adapted to extend between two ends thereof, so as to form a duct (12) of the focusing gun, for at least one of the two pieces and laterally with respect to the planar median region (4, 5) thereof, at least one bonding reservoir (9) filled with a quantity of adhesive substance (11) adapted to adhere to the portion of the assembly face of the other piece lying opposite said reservoir, said focusing gun comprises:

formed on the assembly face (J) of at least one piece (2, 2'), at least one central rib (6), which projects from said assembly face, and for each centering rib (6) formed on the assembly face (J) of one piece and arranged in the assembly face (J) of the other piece, a centering cavity (7), tightly receiving each of said respective centering rib.

* * * * *